United States Patent [19]

Pupillo et al.

[11] Patent Number: 4,679,836

[45] Date of Patent: Jul. 14, 1987

[54] CLOSURE LATCH

[75] Inventors: Dominic S. Pupillo, Sterling Heights; Luben Scheff, Rochester Hills, both of Mich.

[73] Assignee: General Motors Corporation, Detroit, Mich.

[21] Appl. No.: 842,151

[22] Filed: Mar. 21, 1986

[51] Int. Cl.[4] ..... E05C 3/26

[52] U.S. Cl. ..... 292/216; 292/244; 292/337; 292/DIG. 26; 292/DIG. 56

[58] Field of Search ..... 292/216, 280, 341.12, 292/337, 244, DIG. 26, DIG. 56

[56] References Cited

U.S. PATENT DOCUMENTS 3,601,883 8/1971 Arlauskas et al. ..... 29/434

4,575,138 3/1986 Nakamura et al. ..... 292/216

*Primary Examiner*—Richard E. Moore

*Attorney, Agent, or Firm*—Herbert Furman

[57] ABSTRACT

A vehicle body closure latch which is formed of a single handed latch unit, a single handed actuating unit, and a single handed bumper unit which can be assembled in either a right hand or a left hand configuration.

8 Claims, 7 Drawing Figures

CLOSURE LATCH

This invention relates generally to closure latches for vehicle bodies and more particularly to door latches for occupant exit and entry doors of a vehicle body.

Since the advent of the automotive industry, vehicle body door latches have been of several types, including slide bolt type latches, rotary gear type latches, clam shell or jaw type latches, and fork bolt type latches. Regardless of the type of latch, each has been designed: (1) as an integral structure; (2) for specific use as either a right hand or left hand latch; and, (3) for specific use as either a front door or rear door latch. Thus, for each vehicle body, specific door latches must be designed and manufactured for the right hand front door, the left hand front door, the right hand rear door, and the left hand rear door.

The door latch of this invention differs from such prior art latches in that it is comprised of self-contained single handed modules or units which can be assembled in either a right hand or a left hand mode or configuration. The right hand configuration can be used for all right hand doors, both front and rear, and the left hand configuration can likewise be used for all left hand doors. The same units are used in both configurations. The manner of assembly is the only variable.

In the specific embodiment of the invention, the door latch includes three modules or units: a latch unit; an actuating unit controlling the release of the latch bolt of the latch unit; and a bumper unit which guides the movement of the striker into the latch unit and also cushions the striker when the striker engages the latch bolt. These three units can be assembled in a right hand configuration or a left hand configuration without any additional parts and the resultant latch will perform all of the desired latching functions. The components of each unit are single handed and intended for automatic assembly to further simplify the manufacture of the units and the assembly of the door latch.

The latch unit is of sandwich construction and includes a spaced pair of support plates which are substantially mirror images of each other and which support a fork type latch bolt and a detent for the bolt therebetween. The plates are interconnected by fasteners, such as hollow threaded rivets or bushings, which locate the plates in a predetermined spaced relationship and also provide for mounting of the latch unit to the latch pillar face of the door. The pivots which rotatably mount the bolt and the detent between the plates also interconnect the plates and locate them in a predetermined relationship to each other. Each plate is provided with a throat type opening. The openings are aligned so that the latch unit can be mounted in either a right hand or left hand door as desired and provide for entry of the striker into the latch unit for latching engagement with and disengagement from the latch bolt.

The actuating unit includes a base plate which fits against either plate of the latch unit adjacent the lower portion thereof and is secured thereto, such as through a bolt which extends into one of the hollow threaded fasteners. The base plate includes a pair of end flanges, each of which pivotally mounts a transfer arm. The transfer arms are interconnected transversely of the base plate for simultaneous rotation. One transfer arm engages or is coupled to the detent under a spring bias when the transfer arms are in operating position. Each end flange also pivotally mounts a remote lever which is respective to the transfer arm pivoted to such end flange and is engageable therewith to operate both transfer arms and release the detent, as will be described. One of the remote levers is connected to the inside operator or release and the other remote lever is connected to the outside operator or release.

When the door latch is in a front door configuration, one of the transfer arms is always connected to an outside latch actuator such as a manual key and key cylinder, or a power actuator, and an inside latch actuator such as a manual slide or garnish button or a power actuator. The latch actuators are movable between locked and unlocked positions and place the door latch in a corresponding locked or unlocked condition. When the latch actuators are in unlocked position, the transfer arms are in an operating position and actuation of either remote lever rotates both transfer arms. The coupled transfer arm then releases the detent from the latch bolt to permit the door to be opened. When one latch actuator is in locked position, the transfer arms are moved to a bypass position so that actuation of either remote lever does not result in release of the detent since the remote levers bypass the transfer arms.

When the door latch is in a rear door configuration, one of the transfer arms is usually connected only to the inside latch actuator. The connection between the latch actuators and the one transfer arm is a lost motion connection permitting free movement of the transfer arm relative to the latch actuators. The transfer arms are biased to their operating position by a spring. The spring also functions to maintain the transfer arms in their bypass position through an overcenter relationship with the pivot of the transfer arms.

The bumper unit snap fits to each plate of the latch unit and is always secured to the same plate as the actuating unit. The bumper unit includes a pair of spaced legs interconnected by a web and defining a housing overlying the throat opening of the plate and guiding entry of the striker into the latch unit. The bumper unit mounts a rubber type bumper which is engaged by the striker as the bolt moves to latched position relative thereto.

When the door latch is in a right hand configuration, the latch unit would be mounted to the inside of the latch pillar face of the right hand or passenger door. The actuating unit would be mounted to the forwardly located plate of the latch unit and the bumper unit would be secured to the same plate as the actuating unit.

When the door latch is in a left hand configuration, the latch unit is reversed or rotated about its center line and mounted to the inside of the latch pillar face of the left hand or driver's door. The actuating unit is shifted transversely of the body and the bumper unit is also shifted transversely and rotated end to end. Both are secured as in the right hand configuration.

From the foregoing it can be seen that the units can be easily assembled in right hand and left hand configurations. Since the units are self-contained, the assembly can be very easily and quickly accomplished.

The primary feature of this invention is that it provides a vehicle body door latch which is comprised of single handed self-contained units which can be easily and quickly assembled to each other in either a left hand or right hand configuration. Another feature is that the door latch includes a latch unit, an actuating unit and a bumper unit, with the actuating unit and bumper unit being capable of being assembled to either side of the latch unit to provide an operative door latch assembly of either a right hand or left hand configuration.

These and other features will be readily apparent from the following specification and drawings in which.

Figures 4, 5, 6:
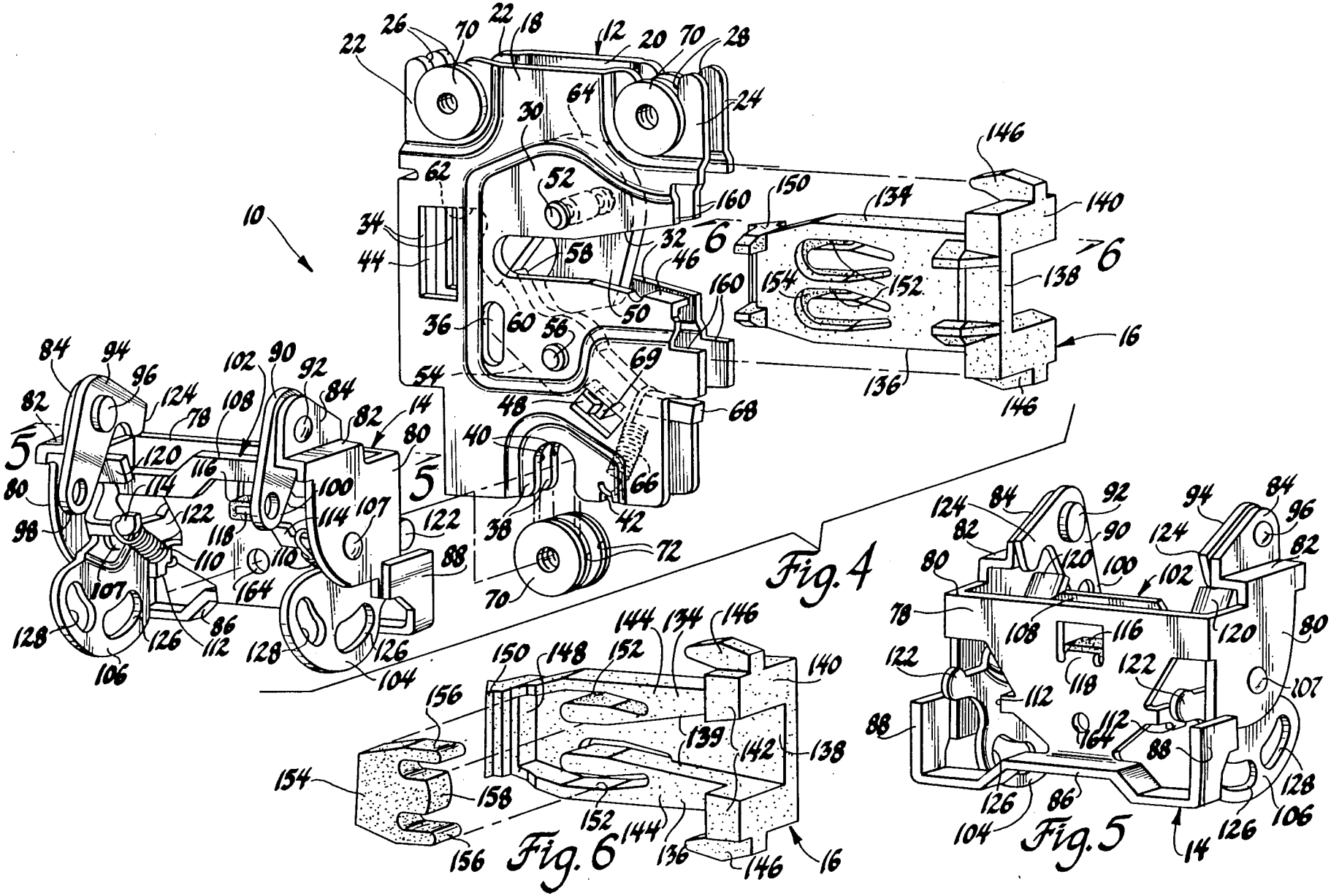
FIG. 4 is an exploded perspective view of the units.
FIG. 5 is a view of the actuating unit taken along line 5—5 of FIG. 4.
FIG. 6 is a view of the bumper unit taken along line 6—6 of FIG. 4.

Referring now first to FIG. 4, a door latch 10 according this invention includes a latch module or unit 12, an actuating module or unit 14 and a bumper module or unit 16. The latch unit 12 includes a pair of plates 18 and 20 which are substantially mirror images of each other and accordingly like numerals will be used for all parts thereof which are the same. The plate 18 includes inwardly depressed corners 22 and 24 which are slotted at 26 and 28, respectively. The plate 18 further includes an inwardly depressed center area 30 which is provided with a throat type opening 32 which opens to the inner side edge thereof. A rectangular vertical slot 34 is provided in the plate 18 transversely of the end of the base of the opening 32, and a slight inwardly depressed vertical area or rib 36 is provided in the depressed center area 30 below the base of the opening 32. An inwardly depressed lower area 38 is provided along the lower edge portion of the plate 18 and a slot 40 extends inwardly from the lower free edge of the area 38. This edge of area 38 is notched at 42.

Figure 3:
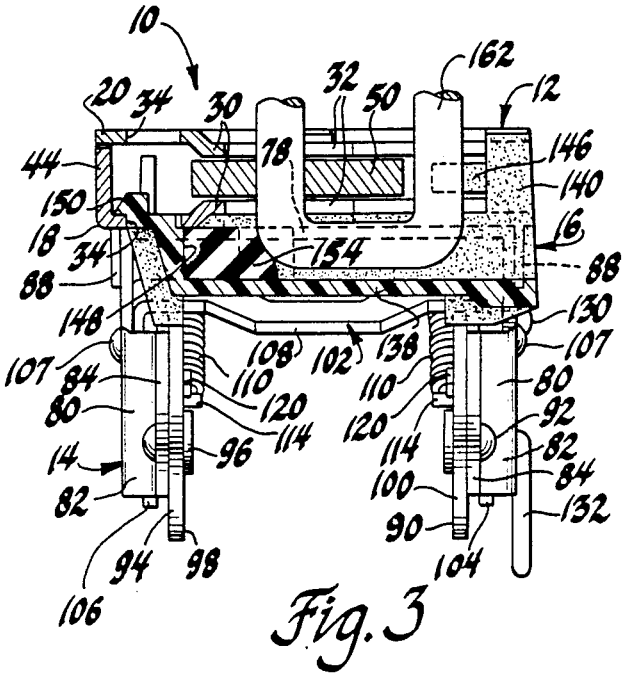
FIG. 3 is a sectional view taken generally along line 3—3 of FIG. 1.

The plate 20, as previously stated, is substantially a mirror image of the plate 18. The differences between these plates are that the plate 18 includes a lateral flange 44, FIG. 3, at the outer side edge thereof, a lateral flange 46 adjacent the inner end of the opening 32, and a lanced inwardly bent leg 48 adjacent the inwardly depressed area 30. The flange 44, as can be seen in FIG. 3, acts as a rear wall for the latch unit. The flange 46 likewise acts as a guide for the striker as will be explained.

Figure 2:
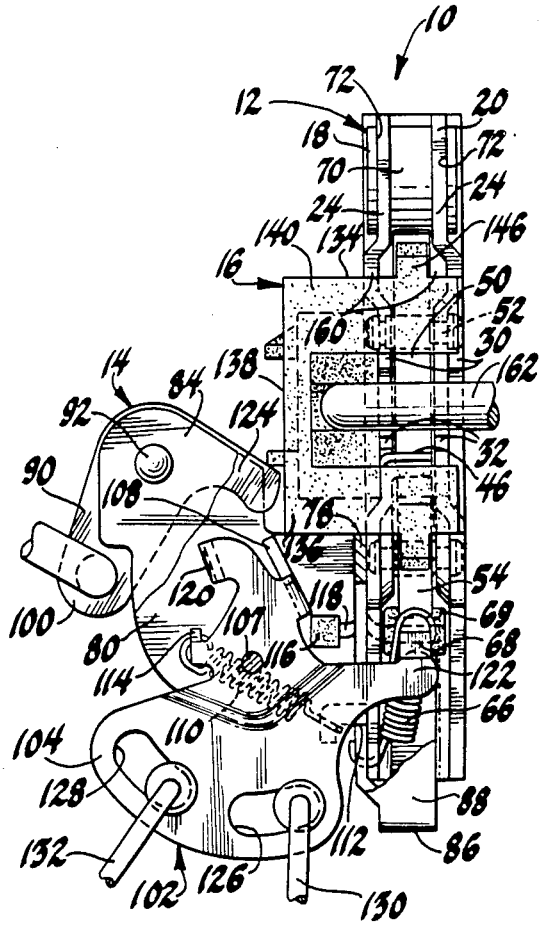
FIG. 2 is a view taken generally along line 2—2 of FIG. 1.

A fork type bolt 50 fits between the plates 18 and 20 and is pivoted thereto by a shoulder type rivet 52. The bolt could be plastic coated in a conventional manner if desired. The rivet 52 , as shown in FIGS. 2 and 4, includes a center cylindrical portion which is received within an aperture of the bolt 50, and a pair of smaller diameter cylindrical ends which fit within apertures in the areas 30 and are headed over plates 18 and 20 to secure the plates to each other. The center portion of the rivet acts as a spacer to locate the plates 18 and 20 in a predetermined spaced relationship when the ends of the rivet are headed over. A detent 54 also fits between the plates 18 and 20 and is mounted thereto by a shoulder type rivet 56 which is the same as the rivet 52 and functions in the same manner, after being headed over, to locate the plates 18 and 20 in a predetermined spaced relationship. The opposing areas or ribs 36 are slidably engaged by the detent 54 and act to space the detent between the plates 18 and 20 inasmuch as the detent is of lesser thickness than the bolt 50. The detent foot 58 is engageable with either shoulder 60 or 62 of the bolt 50 to maintain the bolt in either a fully latched position as shown, or a partially latched position, not shown. When the bolt is in a fully unlatched position, the detent foot 58 rides on the outer edge 64 of the bolt. A tension spring 66 is hooked between the notch 42 and leg 68 of the detent 54 to continually bias the detent clockwise as viewed in FIG. 4, to detented position in engagement with either shoulder 60 or 62 or the edge 64 of bolt 50. When the detent engages shoulder 60 or 62, the detent is located against a rubber bumper 69 on leg 48.

The plates 18 and 20 are further interconnected by three like cylindrical spacers or bushings 70. Each bushing 70 includes a pair of peripheral slots 72, FIG. 4. The slots 72 of the two upper bushings 70 receive the corners 22 and 24 to either side of the respective slots 26 and 28. The bushings 70 cooperate with rivets 52 and 56 in spacing and securing the plates 18 and 20 in a predetermined manner relative to each other. The slots 72 of the lower bushing 70 receive the lower area 38 to either side of slot 40 and function in the same manner as the upper bushings 70. Each of the bushings is centrally threaded. When the plates 18 and 20 are assembled by the headed over rivets 52 and 56 and the bushings 70, the bushings and the heads of the rivets do not extend outwardly of the general plane of the outer side of plates 18 and 20. Other fasteners such as hollow cold headed shouldered rivets similar to rivets 52, could be used instead of bushings 70.

When the latch unit is assembled with the other units, as will be described, to provide a door latch, such latch would be assembled to a vehicle door by bolts, not shown, threaded into the bushings 70.

The actuating unit 14, FIGS. 4 and 5, includes a base plate 78 having a pair of spaced offset flanges 80 which are mirror images of each other. Each flange 80 includes an offset 82 and an apertured upper ear 84. A lower flange 86 of the base plate, which extends oppositely to the flanges 80, includes integral upwardly bent ends 88 which overlie the lower portions of the flanges 80, FIG. 4. A remote lever 90 is pivoted at 92 to one of the ears 84 and a like remote lever 94 is coaxially pivoted at 96 to the other ear 84. In the right hand configuration, an apertured leg 98 of remote lever 94 would be connected to the inside operator or release through a rod or other suitable connector, and the apertured leg 100 of the remote lever 90 would be connected to the outside operator or release through a rod or other suitable connector. In a left hand configuration, shown in FIG. 7, the remote lever 90 would be connected to the inside operator and the remote lever 94 would be connected to the outside operator, as will be further described.

A transfer arm assembly 102 includes a pair of like transfer arms 104 and 106 which are coaxially pivoted at 107 to respective flanges 80 of the base plate 78. These transfer arms are integrally interconnected by a transverse arm 108 for simultaneous rotation.

Figure 1:
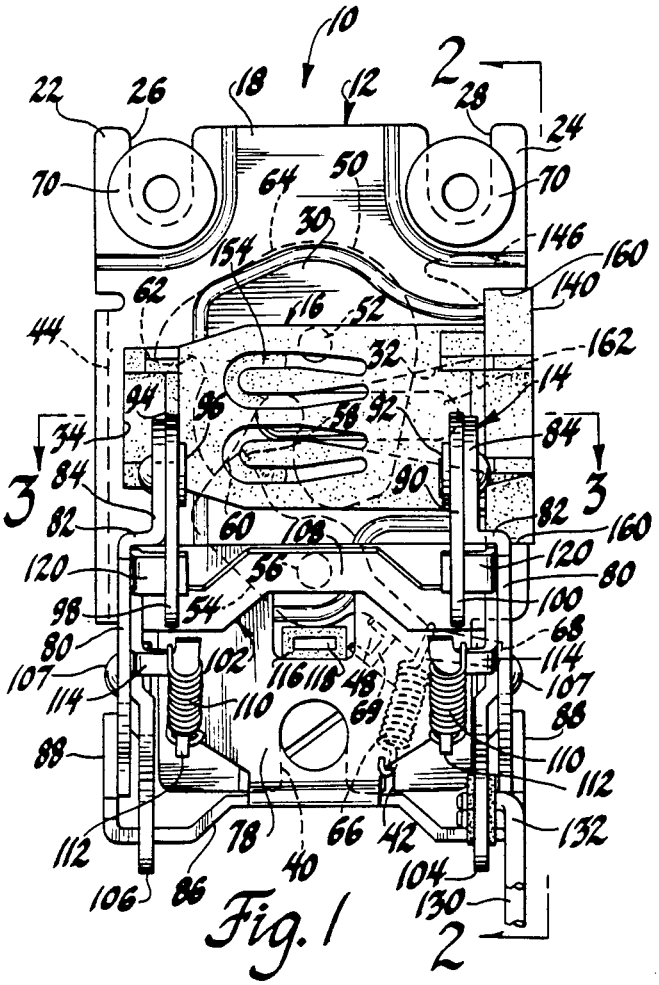
FIG. 1 is a view of a door latch according to this invention with the parts thereof assembled in a right hand configuration.

As shown in FIGS. 1 and 2, tension springs 110 are hooked between laterally bent tabs 112 of plate 78 and laterally bent tabs 114 of each of the transfer arms to bias the transfer arms counterclockwise as viewed in FIG. 2 to operating position, as will be described. The arm 108 is engageable with a rubber bumper 116 on a lanced lateral tab 118 of plate 78 to locate the transfer arms in bypass position, as will be described. Each transfer arm 104 and 106 includes a lateral operating tab 120 and an extended detent operating leg 122, FIGS. 2 and 5. The tabs 120 are engageable by legs 124 of the remote levers 90 and 94 to rotate the transfer arm assembly, as will be described. Each transfer arm 104 and 106 further includes a pair of arcuate slots 126 and 128 generated about the pivot 107. The slots 126 and 128 of transfer arm 104 are respectively connected through a rod and a suitable plastic bushing, schematically indicated at 130 and 132 in FIG. 2, with an outside lock actuator such as a key cylinder, and an inside lock actuator, such as a garnish button or slide button or power actuator.

When the actuating unit 14 is assembled to the latch unit, as shown in FIGS. 1, 2 and 3, to provide a right hand configuration door latch assembly, the leg 122 of the transfer arm 104 underlies and engages the leg 68 of the detent 54, FIG. 2, under the bias of springs 110 to maintain the transfer arms in operating position. As previously mentioned, the remote lever 90 would be connected to the outside operator or handle and the remote lever 94 would be connected to the inside operator or handle. Upon actuation of either of these operators, the clockwise rotation, FIG. 2, of one of the remote levers 90 or 94 would engage the arm 124 thereof with a respective operating tab 120 of transfer arm 104 or 106 to rotate the transfer arm assembly 102 counterclockwise about pivots 107 against the bias of springs 110. The engagement of leg 122 with foot 68 of the detent 54 rotates the detent 54 counterclockwise, as viewed in FIG. 1 and move the foot 58 thereof out of engagement with either shoulder 60 or 62 of the latch bolt 50 and permit the latch bolt to rotate counterclockwise to unlatched position. Upon release of the operator, the springs 110 return the transfer arm assembly 102 to its position shown in FIG. 2 wherein leg 122 engages the foot 68 of detent 54.

During this movement of the transfer arm assembly, the slots 126 and 128 move relative to the rods and bushings 130 and 132. Should either the inside or outside lock actuator be actuated, one of the rods and bushings 130 and 132 will move into engagement with the right hand end, as viewed in FIG. 2, of slot 126 or 128, to rotate the transfer arm assembly clockwise of its position shown in FIG. 2 so that the biasing force of the springs 110 will be located above the pivotal axis 107 as leg 122 of transfer arm 104 moves downwardly and out of engagement with the detent foot 68 and the tabs 120 move clockwise and out of the path of the legs 124 of the remote levers 90 and 94. The engagement of arm 108 with rubber bumper 116 locates the transfer arms in bypass position under the overcenter bias of springs 110. Thereafter should either remote lever be actuated by an inside or outside operator, the leg 124 will bypass the tab 120 of a respective transfer arm so that the detent will remain in detented position. This free wheeling feature, the location of the tabs 120 out of the path of the legs 124, can be accomplished when the vehicle door is closed, to thus uncouple both inside and outside operators from the transfer arm assembly. It can also be accomplished when the door is opened. In the latter instance, closing of the door will retain the transfer arm assembly in the bypass position so that keyless latching can be accomplished.

The bumper unit 16 shown in FIGS. 4 and 6 is of molded plastic material and includes a pair of legs 134 and 136 interconnected by an integral web 138. The legs 134 and 136 have their opposed edges 139 following the general contour of the edges of the openings 32 in the plates 18 and 20. The bumper unit generally provides a housing overlying the opening 32 of the plate 18 or 20 to which it is attached. The legs are further interconnected at their outer ends by a generally C-shaped wall 140 having portions 142 thereof extending outwardly of the sides 144 of the legs 134 and 136. Wall 140 is provided with hook type tabs 146. The inner ends of the legs 134 and 136 are interconnected by an inner end wall 148 having a hook type edge 150, FIG. 3. Portions 152 of each of the legs are cut out as shown in FIGS. 4 and 6. A rubber bumper 154 seats against wall 148 and has portions 156 thereof received within the cutouts 152 and a bumper portion 158 thereof received between the legs.

As previously mentioned, the bumper unit 16 is always mounted on the same plate as the actuating unit 14. In the right hand configuration of the latch as shown in FIG. 4, the bumper unit 16 is mounted to the plate 18 by having the edge 150 hooked through the slot 34 of plate 18 and the tabs 146 clamped between plates 18 and 20. The sides 144 of the legs 134 and 136 engage the inwardly depressed center area 30 and the edges 139 of the legs are generally aligned with the edges of the opening 32 of the plate. The wall 140 is received within cutouts 160 in the outer edges of plates 18 and 20 to each side of opening 32.

As can be seen from FIG. 2, the legs 134 and 136 and the web 138 define a throat which is an extension of the throat defined by the opening 32 of plate 18 for receipt of the bight of a U-shaped striker 162 when the vehicle door on which the door latch is mounted is closed. The legs of the striker are received in the opening 32. As the door is closed, the outboard leg of the striker will engage the inboard leg of the latch bolt 50, the left hand leg viewed in FIG. 1, to rotate the latch bolt from its unlatched position to either its intermediate latched position, wherein the detent head 58 engages shoulder 62 or its fully latched position, as shown in FIG. 1, wherein the detent foot engages the shoulder 60. The outboard leg of the striker engages and depresses the bumper portion 158 of the bumper 154 as the latch bolt moves to latched position around the outboard leg of the striker. This acts as an anti-rattle feature.

The door latch 10 is mounted on the latch pillar face of the door by means of bolts, not shown, which extend through the latch pillar face of the door and thread into the bushings 70. It will be noted with reference to FIG. 4 that the actuating unit 14 has an aperture 164. When the actuating unit is mounted to the latch unit, the aperture 164 is aligned with the opening of the lower bushing 70, FIG. 4, and the flange 86 and the ends 88 of this flange together with legs 80 straddle the lower portion of the latch unit. The actuating unit is secured to the latch unit by the bolt shown which threads partially into the lower bushing 70. This bolt shares the lower bushing 70 with the door latch attachment bolt.

Figure 7:
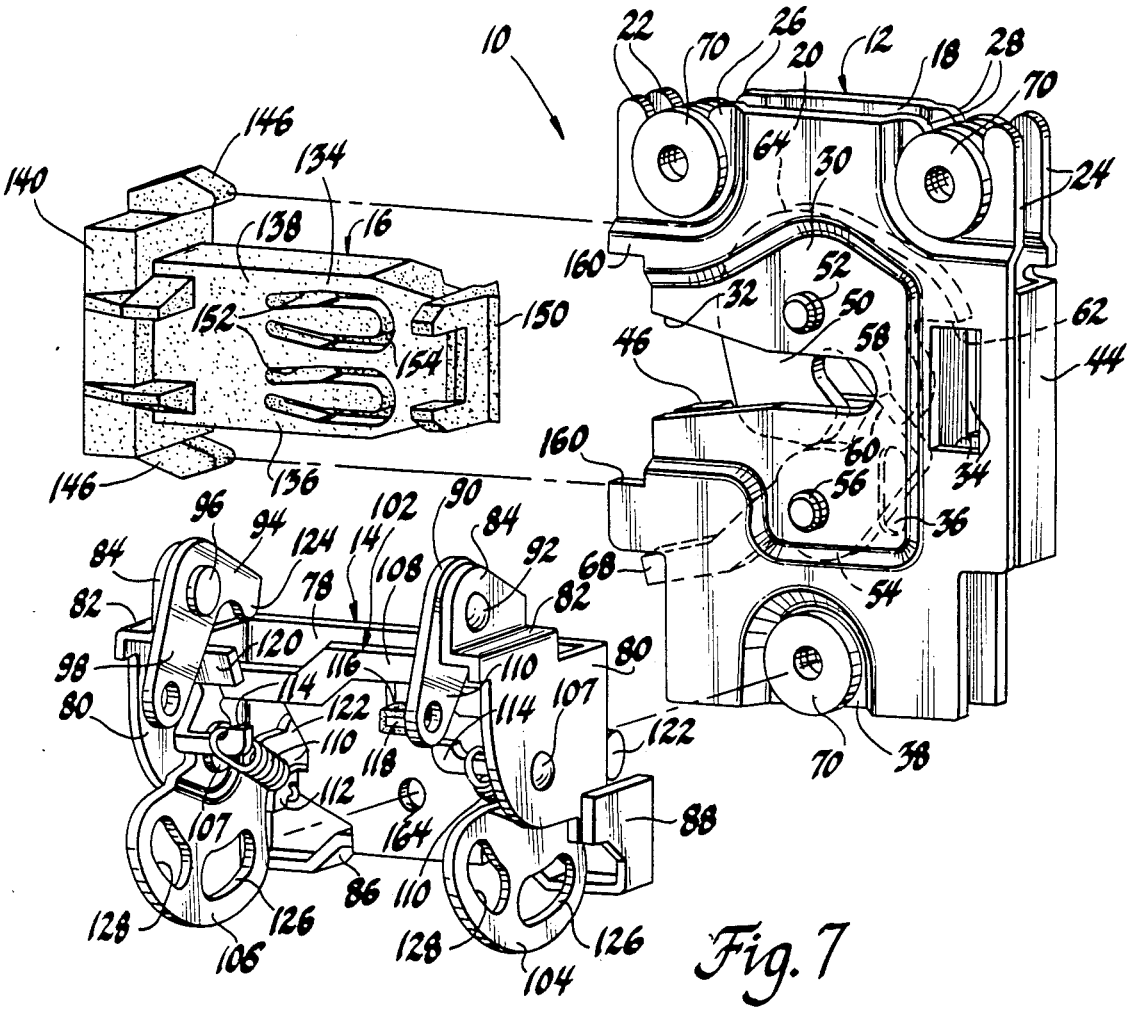
FIG. 7 is an exploded perspective view of the units in a left hand configuration.

FIG. 7 shows the latch unit 12, the actuating unit 14 and the bumper unit 16 in the left hand configuration door latch. These three units are the same when used in either a right hand or left hand configuration as previously mentioned since the units are single handed and the parts thereof are single handed. When these units are assembled in a left hand configuration, it can be seen, by comparing FIGS. 4 and 7, that the latch unit is rotated 180° about its central vertical axis so that the latch plate 20 now faces forwardly of the body and the latch plate 18 abuts the inner surface of the latch pillar face of the left hand door. The actuating unit 14, since it is symmetrical, is merely shifted transversely of the body and is assembled in the same manner to the plate 20 as it was assembled to the plate 18. However, now the left hand transfer arm 106 would have its leg 122 engaging the detent leg 68 rather than the transfer arm 104. The remote levers 90 and 94 would be transposed in their connections to the inside and outside operators and likewise the transfer arms 104 and 106 would be transposed in their connections to the inside and outside lock operators.

The bumper unit 16 would be turned end to end and would now seat against the outer side of the inwardly depressed center area 30 of plate 20 rather than that of plate 18. The bumper unit 16 is attached to the plate 20 in the same manner as it is attached to the plate 18. As shown in FIG. 7, plate 20 does not have the flange 44, leg 48 and notch 42 of plate 18. The lower area 38 is also of a different shape.

From the foregoing description it can be seen that the door latch of this invention is comprised of self-contained single handed units which can be assembled in either a right hand or left hand configuration so that the same such units can be used to provide modular built door latches for either right hand or left hand vehicle doors as well as for right hand front and rear doors and left hand front and rear doors. The units are the same in both configurations and the only difference is the manner of assembly. Although the door latch has been described as a fork bolt type latch having keyless locking, the type of latch could be changed to another type latch, if so desired. Likewise, the keyless locking function can or cannot be included, as desired, and other features, such as automatic undogging, could be included. The type of inside and outside operators, whether handles or otherwise, and the type of connection between such operators and the remote levers and transfer arms, can be rods or cables or otherwise. Power actuation could also be provided, if so desired.

Thus this invention provides an improved closure latch for the occupant doors of a vehicle body which is comprised of self-contained single handed units which can be assembled in either a right hand configuration or a left hand configuration.

The embodiments of the invention in which an exclusive property or privilege is claimed are defined as follows:

1. A vehicle body closure latch formed of the same units assembled in either a right hand or a left hand configuration, comprising, in combination, a latch unit having a vertical center line about which the latch unit is rotatable 180° between a right hand position and a left hand position and including:

a frame having right hand and left hand sides, a latch bolt mounted on the frame for movement between latched and unlatched positions, a detent mounted on the frame and engageable with the latch bolt for maintaining the latch bolt in latched position, a latch actuating unit mounted to the right hand side of the frame in a right hand latch configuration and mounted to the left hand side of the frame in a left hand latch configuration, the actuating unit including:

a spaced pair of detent release levers movable between operating and bypass positions, means interconnecting the detent release levers for concurrent movement between the positions thereof, one detent release lever being connectable with the detent to release the detent and the other detent release lever concurrently moving with the one detent release lever when the detent release levers are in operating position and the actuating unit is mounted to the right hand side of the frame in a right hand configuration, the other detent release lever being connectable with the detent to release the detent and the one detent release lever concurrently moving with the other detent release lever when the detent release levers are in operating position and the actuating unit is mounted to the left hand side of the frame in a left hand configuration, a pair of operating levers, each engageable with one detent release lever to concurrently move the one and the other detent release levers when the release levers are in operating position and release the detent, latch actuating means operatively connected to at least one of the detent release levers for concurrently moving the one and the other detent release levers between the operating position and the bypass position, the operating levers bypassing the detent release levers when the detent release levers are in the bypass position, a bumper unit mounted to the same side of the frame of the latch unit as the actuating unit for guiding relative movement of the latch bolt and a striker, and cooperating means on each of the units for assembling the units in the right hand and left hand configurations.

2. The combination recited in claim 1 wherein the actuating unit additionally includes:

(1) resilient means alternately biasing the detent release levers to the operating position or to the bypass position and, (2) means engageable by the detent release levers under the bias of the resilient means to locate the detent release levers in bypass position.

3. The combination recited in claim 1 wherein each detent release lever includes an arm engageable with the detent when the detent release lever is in the operating position, and the latch actuating means additionally includes resilient means alternately biasing the detent release levers to the operating position to engage the detent release lever arms with the detent or to the bypass position, the arm of the connected detent release lever engaging the detent under the bias of the resilient means to locate both detent release levers in operating position.

4. The combination recited in claim 1 wherein the frame has aligned openings in each side thereof which include spaced legs permitting entry and exit of a striker therebetween, and the bumper unit includes:

a pair of legs positionable laterally and in general alignment with the legs of the side of the frame to which the bumper unit is mounted, and a web interconnecting the legs and cooperable therewith to define a housing for receipt of a striker.

5. The combination recited in claim 1 wherein the frame has aligned openings in each side thereof which include spaced legs permitting entry and exit of a striker therebetween, and the bumper unit is of molded plastic material and includes:

a pair of legs positionable laterally and in general alignment with the legs of the side of the frame to which the bumper unit is mounted, a throat portion integrally connecting the legs and a web integrally interconnecting the legs and throat portion and cooperable therewith to define a housing for receipt of a striker, and a resilient bumper mounted on the web of the bumper unit and engageable with and disengageable from the striker to cushion relative movement of the striker and the latch bolt.

6. A vehicle body closure latch formed of the same units assembled in either a right hand or a left hand configuration, comprising, in combination, a latch unit having a vertical center line about which the latch unit is rotatable 180° between a right hand position and a left hand position and including:

a frame having right hand and left hand sides, a latch bolt mounted on the frame for movement between latched and unlatched positions, a detent mounted on the frame and engageable with the latch bolt for maintaining the latch bolt in latched position, a latch actuating unit mounted to the right hand side of the frame in a right hand latch configuration and mounted to the left hand side of the frame in a left hand latch configuration, the actuating unit including:

a transfer arm assembly including a spaced pair of coaxially pivoted detent release levers connected to each other for concurrent movement between operating and bypass positions, one detent release lever being connectable with the detent to release the detent and the one other detent release lever concurrently moving with the detent release lever when the detent release levers are in operating position and the actuating unit is mounted to the right hand side of the frame in a right hand configuration, the other detent release lever being connectable with the detent to release the detent and the one detent release lever concurrently moving with the other detent release lever when the detent release levers are in operating position and the actuating unit is mounted to the left hand side of the frame in a left hand configuration, a pair of operating levers, each engageable with one detent release lever to concurrently move the one and the other detent release levers when the release levers are in operating position and release the detent, latch actuating means operatively connected to at least one of the detent release levers for concurrently moving the one and the other detent release levers between the operating position and the bypass position, the operating levers bypassing the detent release levers when the detent release levers are in the bypass position, a bumper unit mounted to the same side of the frame of the latch unit as the actuating unit for guiding relative movement of the latch bolt and a striker, and cooperating means on each of the units for assembling the units in the right hand and left hand configurations.

7. A vehicle body closure latch formed of the same units assembled in either a right hand or a left hand configuration, comprising, in combination, a latch unit having a vertical center line about which the latch unit is rotatable 180° between a right hand position and a left hand position and including:

a frame of sandwich type construction including a right hand plate and a left hand plate of generally mirror image, means including a number of pivot means locating the plates in predetermined spaced relationship, a latch bolt mounted on one pivot means for movement between latched and unlatched positions, a detent mounted on another pivot means and engageable with the latch bolt for maintaining the latch bolt in latched position, a latch actuating unit mounted to the right hand plate of the frame in a right hand latch configuration and mounted to the left hand plate of the frame in a left hand latch configuration, the actuating unit including:

a spaced pair of detent release levers movable between operating and bypass positions, means interconnecting the detent release levers for concurrent movement between the positions thereof, one detent release lever being connectable with the detent to release the detent and the other detent release lever concurrently moving with the one detent release lever when the detent release levers are in operating position and the actuating unit is mounted to the right hand plate of the frame in a right hand configuration, the other detent release lever being connectable with the detent to release the detent and the one detent release lever concurrently moving with the other detent release lever when the detent release levers are in operating position and the actuating unit is mounted to the left hand plate of the frame in a left hand configuration, a pair of operating levers, each engageable with one detent release lever to concurrently operate the one and the other detent release levers when the release levers are in operating position and release the detent, latch actuating means operatively connected to at least one of the detent release levers for concurrently moving the one and the other detent release levers between the operating position and the bypass position, the operating levers bypassing the detent release levers when the detent release levers are in the bypass position, a bumper unit mounted to the same side of the frame of the latch unit as the actuating unit for guiding relative movement of the latch bolt and a striker, and cooperating means on each of the units for assembling the units in the right hand and left hand configurations.

8. A vehicle body closure latch formed of the same units assembled in either a right hand or a left hand configuration, comprising, in combination, a latch unit having a vertical center line about which the latch unit is rotatable 180° between a right hand position and a left hand position and including:

a latch frame including spaced right hand and left hand support plates, a plurality of pivot means extending between the plates and securing the plates to each other in a predetermined spaced relationship, fastener means for fastening the latch unit to a vehicle body closure and extending between the plates to additionally secure the plates to each other in said predetermined spaced relationship, a latch bolt pivotally mounted on one of the pivot means for rotation between the plate between latched and unlatched positions, a detent pivotally mounted on another pivot means for rotation between the plates between an undetented release position and a detented position in engagement with the latch bolt to maintain the latch bolt in latched position, a latch actuating unit mounted to the right hand plate of the frame in a right hand latch configuration and mounted to the left hand plate of the frame in a left hand latch configuration, the actuating unit including:

a pivotally mounted transfer arm assembly having a spaced pair of detent release levers interconnected for concurrent rotation, one detent release lever being connectable with the detent to release the detent and the other detent release lever concurrently moving with the detent release lever when the detent release levers are in operating position and the actuating unit is mounted to the right hand plate of the frame in a right hand configuration, the other detent release lever being connectable with the detent to release the detent and the one detent release lever concurrently moving with the other detent release lever when the detent release levers are in operating position and the actuating unit is mounted to the left hand plate of the frame in a left hand configuration, latch actuating means operatively connected to at least one of the detent release levers for pivoting the transfer arm assembly to position the detent release levers in either an operating position or a bypass position, the latch actuating unit further including:

a pair of independently operable operating levers, each respective to one detent release lever and engageable therewith when such detent release lever is in an operating position to pivot the transfer arm assembly and cause the connected detent release lever to release the detent, each operating lever bypassing a respective detent release lever when the detent release levers are positioned in the bypass position by the latch actuating means, a bumper unit mounted to the same side of the frame of the latch unit as the actuating unit for guiding relative movement of the latch bolt and a striker, and cooperating means on each of the units for assembling the units in the right hand and left hand configurations.

* * * * *